US005249565A

United States Patent [19]

Saunders et al.

[11] Patent Number: 5,249,565

[45] Date of Patent: Oct. 5, 1993

[54] CAM-CONTROLLED, SWINGER ARROW REST

[75] Inventors: Charles A. Saunders, Columbus; Benedict M. Paczosa, Duncan, both of Nebr.

[73] Assignee: Saunders Archery Company, Columbus, Nebr.

[21] Appl. No.: 895,280

[22] Filed: Jun. 8, 1992

[51] Int. Cl.[5] ..... F41B 5/22

[52] U.S. Cl. ..... 124/44.5; 124/24.1

[58] Field of Search ..... 124/24.1, 25.6, 44.5, 124/86, 88

[56] References Cited

U.S. PATENT DOCUMENTS

| | | | |
|---|---|---|---|
| 3,828,757 | 8/1974 | Finlay | 124/44.5 |
| 4,473,058 | 4/1984 | Terry | 124/24.1 |
| 4,676,220 | 6/1987 | Pietraszek | 124/44.5 |
| 4,686,956 | 8/1987 | Troncoso | 124/44.5 |
| 4,715,355 | 12/1987 | Lattig | 124/44.5 |
| 4,748,964 | 6/1988 | Troncoso | 124/44.5 |
| 4,809,669 | 3/1989 | Saunders | 124/24.1 |
| 4,838,237 | 6/1989 | Cliburn | 124/44.5 |
| 4,898,145 | 2/1990 | Simo | 124/44.5 |
| 4,924,841 | 5/1990 | Smith | 124/44.5 |
| 5,062,407 | 11/1991 | Newbold | 124/44.5 |

*Primary Examiner*—Randolph A. Reese
*Assistant Examiner*—John Ricci
*Attorney, Agent, or Firm*—Michael G. Berkman

[57] ABSTRACT

An arrow rest assembly includes a mounting plate for securement to the side window wall of an archery bow. The plate is rotatable in a plane paralleling the window wall or bow riser and is also shiftably positionable against the wall or spaced therefrom. The resulting two degrees of freedom facilitate orientational adjustment, thereby to support the assembly in a desired location and attitude. The arrow rest includes a generally horizontal arrow shaft support arm on which a generally vertical arrow-shaft-abutting leg is slidably mounted. The leg may be locked in a selectable position along the lineal expanse of the support arm. A shaft extending upwardly of the support arm at an end thereof adjacent the bow window is journaled for arcuate pivotal articulation of the arrow rest support elements in a tubular sleeve formed in the mounting plate of the assembly. A spring secured to the mounting plate bears resiliently on an eccentric cam fastened on the shaft to bias the support bar or arm together with the side bar or leg of the arrow rest to a "ready" position. Stress forces applied by the arrow shaft against the shaft-engaging bar element of the arrow rest effectively overcome the biasing force of the cam-engaging spring pivotally, and temporarily, to displace the shaft-engaging bar laterally inwardly toward the side wall of the bow window, as the arrow is released in flight. The arrow rest then promptly returns and assumes a standby position.

17 Claims, 2 Drawing Sheets

CAM-CONTROLLED, SWINGER ARROW REST

BACKGROUND AND FIELD OF THE INVENTION

The present invention relates to an arrow rest for securement to a side wall of a window of an archery bow. More particularly, the invention is directed to an arrow rest assembly which is fastened to the bow window side wall in a manner such that the arrow rest may be slidably positionable against or spaced from the side wall, and is also rotatable in a vertical plane to assume a selectable angle or pitch, in which attitude the assembly may then be firmly and simply locked.

Arrow rests of the prior art have taken both simple as well as relatively complex forms. The structural materials adopted have also varied greatly. The art is replete with diverse designs of combination arrow rests and side designs of combination arrow rests and side supports. Relatively simple yet highly effective structures are described in C. Saunders U.S. Pat. No. 4,809,699 and in C. Saunders U.S. Pat. No. 4,865,007. The entire disclosure of these patents is hereby specifically incorporated herein by reference, to the extent not inconsistent herewith.

Many of the combination arrow rests and side support arrow rests of the prior art lack versatility or practical repositioning capability for accommodating the particular archer, or for adapting the arrow rest to the unique characteristics of a specific fletched arrow shaft. Many rely on fixed settings which can be varied or modified only with considerable inconvenience or difficulty. Few lend themselves to simple adjustments in lateral positioning and/or annular orientation. For the most part it becomes almost only fortuitous if a given arrow rest proves more than merely acceptable to a particular user. Adjustments to improve the operation or to adapt the arrow rest to individual archer's requirements have usually been difficult or even impossible. As a result, archers have often felt constrained to "settle for" or use arrow rests which do not ensure to them optimum results.

It is, therefore, a principal aim of the present invention to provide a combination arrow rest and side support assembly which may be readily and simply mounted in selectable spacing from the side of the window wall and which may also be rotated to assume a preferred angular mode. Additionally the arrow rest of the present invention is characterized in that the arrow rest and arrow shaft guide are responsive to forces impressed thereagainst by the arrow shaft on its release from the bow to swing toward the window wall to minimize interference with the arrow feathers or flutings.

SUMMARY OF THE INVENTION

The present invention constitutes, in combination, an arrow rest and side support with a bow-mounted support plate. The support plate is shiftable and selectively positionable outwardly from a window wall of the bow to which the plate is fastened. The support plate is also pivotally adjustable in a plane paralleling the bow window side wall. The arrangement described lends multiple degrees of freedom to the fine positioning and to the angular orientation of the arrow rest itself.

The combination arrow rest and side support is carried on a vertically extending rod which is sleeved in a tubular bushing carried by the mounting plate so that the rest and side support are pivotal in a horizontal arc.

In a preferred embodiment of the invention the element in which the arrow shaft rests is bent upon itself to define a loop which lies in a vertical plane.

A related feature of the invention is that the arrow side support or abutment post is mounted on the arrow rest and is positionable therealong. The assembly is provided with a locking device for firmly securing the post in any preferred position along the length of the arrow rest.

In a preferred embodiment of the invention the mounting plate of the assembly is carried on and secured to an elongate post which is slidably sleeved within a through axial bore in a threaded shaft, the latter being in turn fastened in the window wall of the bow and extending normally thereof.

A related feature of the invention is that the assembly-carrying post may be locked against both axial thrust and sliding movement within, and also against rotational displacement with respect to the bored and threaded bow-mounted shaft.

It is an important structural feature of the arrow rest that it is biased to a stand-by or ready position by means of a spring which bears upon a cam carried on a pivotable rod which supports the arrow rest on a mounting plate. The plate is fastened, in turn, to the wall of the window of the bow.

A related feature of the invention is that the arrow rest, with the side support, is momentarily displaced toward the wall of the bow window as a result of frictional forces impressed by the arrow shaft when the shaft is propelled from the bow.

The arrow rest assembly of the present invention is further characterized in that rotational force impressed by a biasing spring acting on an arrow rest supporting rod acts effectively to return the rest to a ready or stand-by mode once the arrow shaft has left the bow.

One preferred embodiment of the invention features a band or single-leaf type flat spring which bears upon a rest-carried, rod-mounted cam to bias the arrow rest and side support to a stand-by position, prior to flight release of the arrow shaft from the bow.

A related feature of the invention is that bowstring-impelled travel of the arrow shaft along and in contact with the arrow rest and side support of the assembly acts through a cam to impress distortion forces on a spring which stresses the arrow rest and side support.

In accordance with the practice of the present invention spring-generated bias forces may be varied by adjusting the orientation and/or the spacial contour of a spring-engaged cam carried by the arrow rest assembly.

In one embodiment of the invention the cam form permits the arrow shaft engaging components to assume two different stable modes including a ready mode and a mode in which the assembly is displaced toward the side wall of the bow window.

In another embodiment of the invention the mounting plate is attached to a post secured, in turn, to the window side wall of the bow.

Yet another feature of the arrow rest of the invention is that it may be secured in place by means of double-faced adhesive tape, or in any other preferred manner.

DETAILED DESCRIPTION OF ILLUSTRATED EMBODIMENT

The aims and objects of the invention are accomplished by providing, for archery use, a plate-mounted combination generally horizontal arrow rest support arm and a shaft-abutting, vertical side support or leg. The arm and leg assembly is pivotally secured to a sleeved shaft journaled for articulation arcuately against the bias of a spring mounted on a plate which is in turn fastened to the archery bow at a side window wall thereof. The plate is, in turn, mounted for selective adjustable positioning either against or displaced laterally from the bow sidewall. Additionally, the assembly mounting plate may be rotated in an arc defining a vertical plane which generally parallels the window wall of the archery bow, thus ensuring several degrees of freedom of adjustment for the entire arrow rest and support assembly.

An important feature of the arrow rest of the invention is the provision of a cam and spring arranged to bias the arrow-shaft-abutting side support or leg to hold the arrow shaft in an at rest or ready mode. Lateral forces derived from lateral shifting of the arrow shaft during its release from the bow act upon the side support to displace the latter toward the window wall of the archery bow. Concurrently, the sleeved support shaft of the arrow rest rotates, and a cam mounted and fixed on the rod or shaft stresses resiliently against the plate-mounted spring. Upon flight release of the arrow shaft from the bow, the spring pressure stressing the cam is effective to return the arrow rest and support assembly to its stand-by mode.

In a second embodiment of the invention the cam is contoured to define two distinct stable or "at rest" facets or faces. In this arrangement the arrow rest and support assembly assumes a second stable rest position when shifted arcuately by the arrow shaft and against the pressure of the cam-engaging spring. The assembly may then be "reset" manually to a "ready" or stand by mode.

Figure 1:
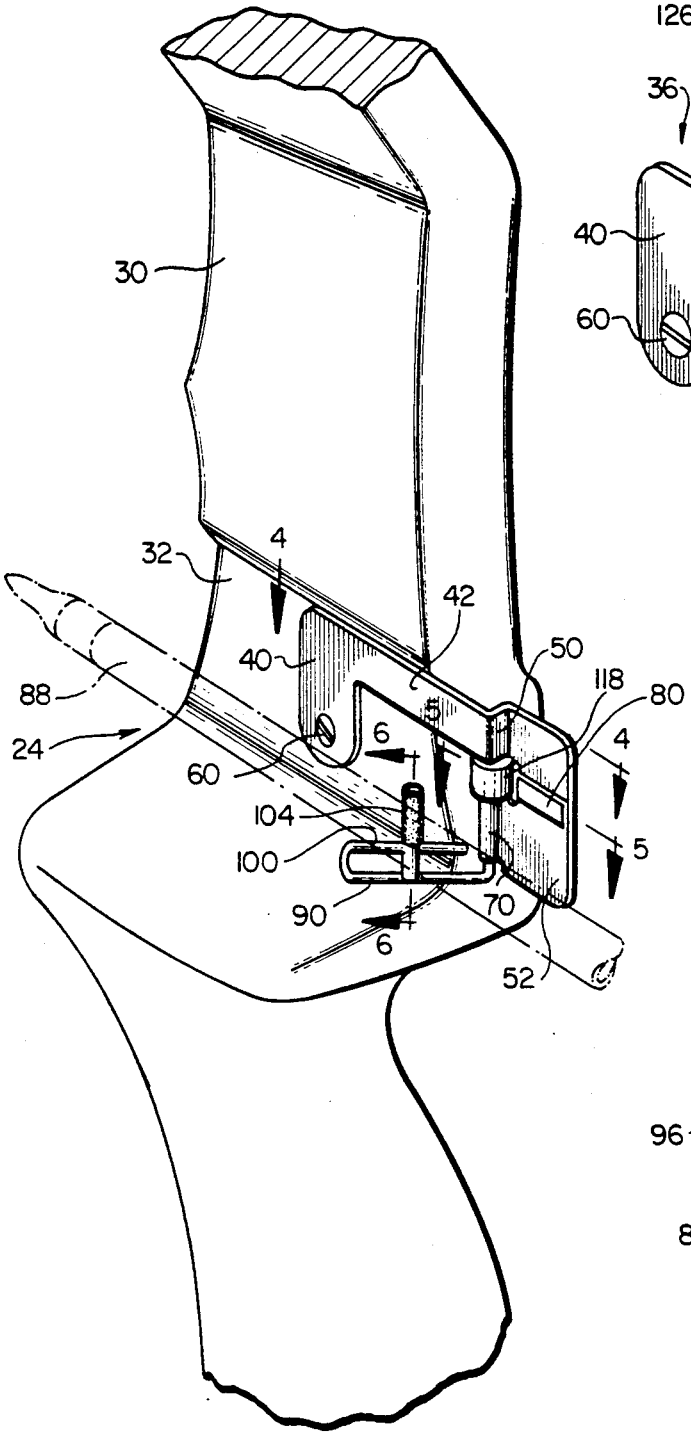
FIG. 1 is a perspective fragmentary view of a center portion of a bow showing a cam-controlled swinger arrow rest assembly, according to the present invention, mounted in the window zone of an archery bow, with an arrow shaft supported and in place.
Figure 2:
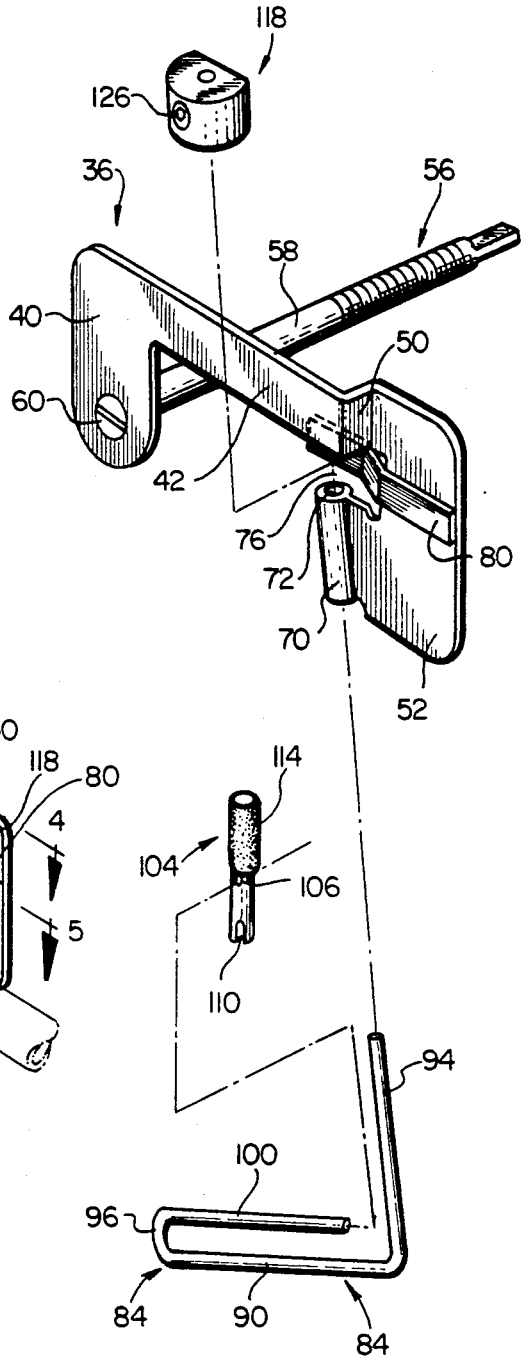
FIG. 2 is an exploded view depicting the several principal mechanical elements of the arrow rest and side support of the invention, and the manner of assembly.

Referring now to the drawings, for purposes of disclosure, and not in any limiting sense, one preferred embodiment of the combination arrow rest and arrow shaft support and guide assembly 20 of the invention is shown in FIGS. 1 and 2, secured in a window zone 24 of an archery bow 30, to the sidewall 32 thereof. A mounting plate 36 of the assembly 20 is preferably of a unitary construction and includes a body section 40 joined to a generally rearwardly extending arm 42 integrally joined at an end 46 thereof through an offset flange 50 to an inwardly-displaced second plate-like section 52.

A bolt 56 having a shaft 58, and an enlarged head 60 secured in the body 40 of the plate 36, extends through a cooperating through bore 62 in the window wall 32 of the bow 30. A locking nut assembly 66 secures the shaft 56 in selectable positions, laterally and rotationally, in a manner such as is described in detail in Saunders patent application Ser. No. 07/710,463, filed Jun. 5, 1991 and allowed Feb. 13, 1992. The entire disclosure of that patent application is hereby specifically incorporated herein by reference, to the extent it is not inconsistent herewith. The plate-like section 52 of the mounting plate 36 carries a bushing 70. In the particular embodiment of the invention shown, the bushing 70 is unitary with the plate 36 itself, constituting a tubular end section of the plate. The same marginal portion 52 of the mounting plate 36 is also formed, in an area immediately above an upper end 72 of the bushing 70, with a cut-away zone 76. A band-like leaf spring 80 is secured to the plate 52 by means of an adhesive, by riveting, or other suitable techniques, to be second plate-like section 52 to extend into the cut-away zone 76, as shown in FIG. 2.

Figure 3:
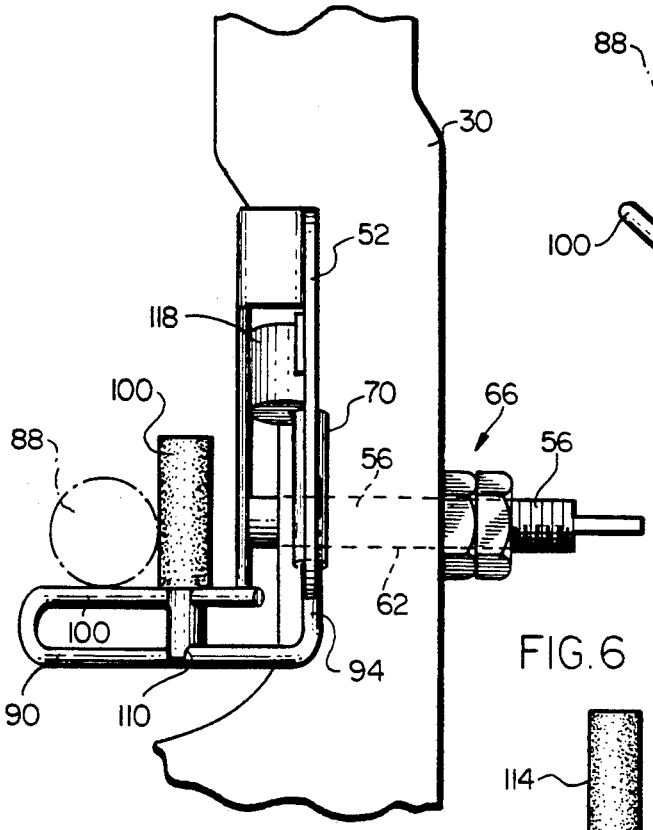
FIG. 3 is a rear elevational view, partly broken away, of the assembly of FIG. 1, with the arrow in a rest position.

Referring further to FIGS. 1, 2 and 3, the arrow rest and guide assembly 20 includes a slide bar structure 84 on which an arrow shaft 88 is slidably supported. In the embodiment of the invention depicted, the structure 84 includes a lower arm 90 extending generally horizontally and integrally joined at one end to an upwardly-directed shaft 94. At its opposite end 96 the arm 90 is bent upwardly and reversely upon itself to form an upper arm 100 which overlies the lower arm 90 and is disposed generally parallel thereto.

Mounted on and slidably positionable along the trombone-like upper and lower arms 100 and 90 of the arrow rest assembly is an upward extending leg 104 against which the arrow shaft 88 bears upon being shot from the bow 30. The leg 104 is formed at a mid-region thereof with a through diametric bore 106 through which the upper arrow support arm 100 passes. At its lower extremity the leg 104 is formed with a downwardly opening groove 110 which embracingly receives the lower arm 90 of the slide bar structure and slides therealong as the leg 104 is moved to a desired location along the lineal expanse of the upper arm 100. The leg 104 is readily adjustably positionable.

In the particular embodiment of the invention shown, the upper section 114 of the leg 104 is bored and threaded axially, in communication with the horizontal, diametric bore 106. A set screw, not shown, is advanced through the vertical threads interiorly of the leg 114 to engage the upper arm 100 and lock the leg 104 in selectable locations along the arm 100.

Figure 4:
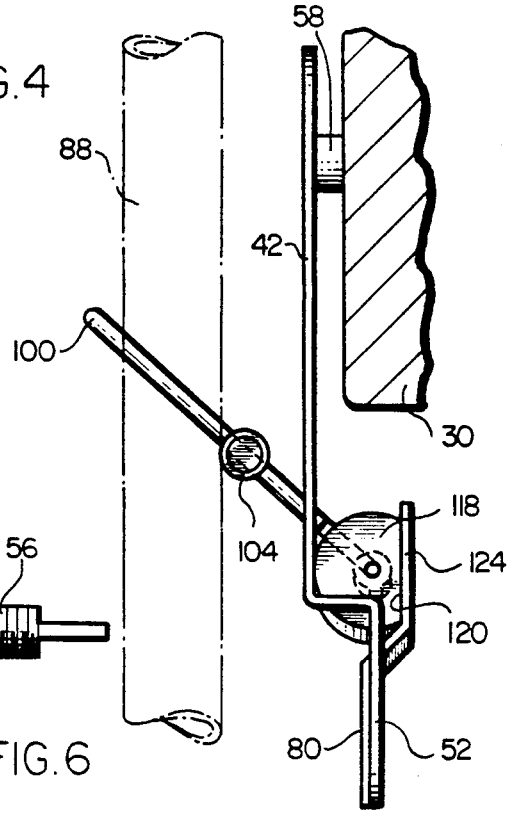
FIG. 4 is a cross sectional view, taken substantially on the lines 4—4 of FIG. 1 and showing the disposition of the arrow support arm, the rod and cam attached thereto, and the biasing spring as fastened to the support plate of the assembly.
Figure 6:
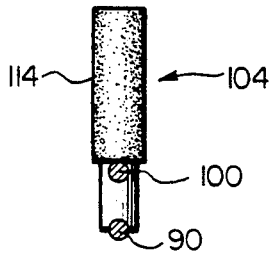
FIG. 6 is sectional view taken substantially on the lines 6—6 of FIG. 1 and showing the arrow-shaft-engaging side bar of the assembly and indicating the mode of attachment to and sliding abutment on the arrow shaft support arm.

As indicated schematically in FIG. 2, and as shown in FIGS. 1 and 3, the shaft 94 of the arrow support bar assembly 84 is sleevedly received within and projects upwardly through the bushing 70 of the plate 52. Mounted on the shaft 94 in a lineal zone thereof coinciding with the cut-away area 76 of the plate 52 is a cam 118. As shown in FIG. 4, a flat face 120 of the cam 118 is in substantially contiguous contact with an offset extension 124 of the spring blade 80. A set screw 126 holds the cam 118 fixed on the shaft 94.

Figure 5:
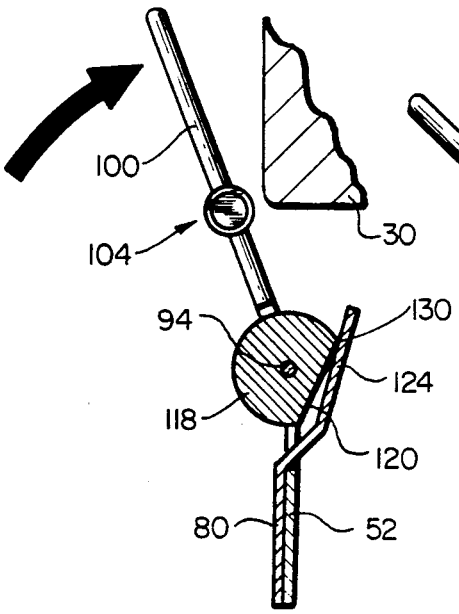
FIG. 5 is a cross sectional view taken substantially on the lines 5—5 of FIG. 1 and indicating schematically the initiation of the pivotal displacement of one embodiment of the cam of the assembly acting resiliently against the stressing biasing spring and momentarily distorting the latter.

When an arrow is shot from the bow 30 the arrow shaft 100 bears laterally against the leg 104 and causes the arrow rest arm 90 to pivot clockwise, as indicated in FIG. 5. At the same time, the cam 118 moves through an arc so that a forward end portion or tip 130 of the cam 118 bears against and forcibly yet resiliently displaces or deforms the extending leaf 124 of the z-shaped spring. When the arrow has left the bow, the bias force of spring leaf 124 returns the cam and the cam and the arm 124 connected thereto to its resting, dormant, or stand-by mode.

Figure 7:
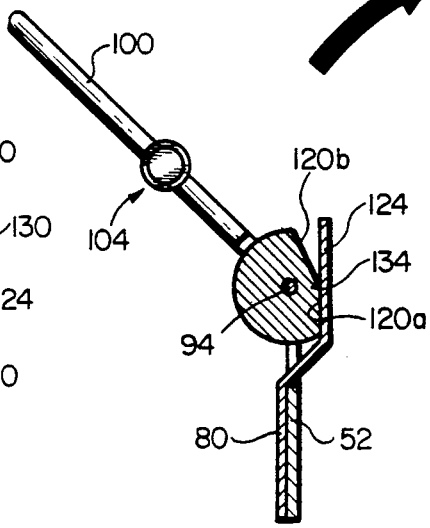
FIG. 7 is a view similar to that shown in FIG. 6, but depicting a modified embodiment of the spring-engaging cam, the cam and spring being shown as they appear when the arrow is at a "rest" position, with a first facet face of the cam in abutment against the spring.
Figure 8:
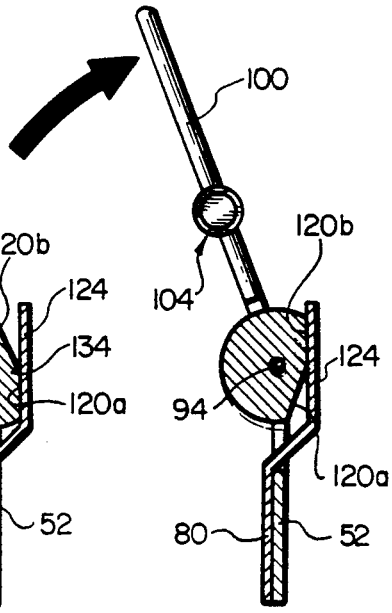
FIG. 8 is a view showing schematically the structure of FIG. 7 with the cam of FIG. 7 in a second "stable" position assumed when the side bar support has been forcibly laterally displaced by the arrow shaft.

A second embodiment of the camming mechanism is shown in FIGS. 7 and 8. The cam 118*a* there depicted is formed with two separate angled flat faces 120*a* and 120*b*. Each represents a stable, rest position. FIG. 7 shows the physical configuration which exists when the arrow shaft is ready for release. During propulsion of the arrow in flight, the shaft 88 bears against the leg 104 pivoting the cam clockwise and temporarily distorting the spring leaf 124 as the apex 134 pivots about the shaft 94, as indicated in FIG. 8. The cam face 120*b* comes to rest against the spring blade 124, and the assembly is again stable, with the arms 100 and 90 and leg 104 assembly displaced toward the side wall 82 of the bow window. It is necessary merely manually forcibly to pivot the assembly to cause it to assume its initial mode, pictured in FIG. 7.

While the present invention has been described with reference to a preferred embodiment, it is obvious that many changes may be made in the size, shape, details and arrangement of the various elements of the invention without departing from the scope and spirit thereof. It is, therefore, intended to include within the appended claims all such variations and modifications.

What is claimed is:

1. A cam-controlled arrow rest comprising a mounting plate for securement to a side wall of a bow window, said plate being disposed to extend in a plane generally paralleling the window side wall, mounting means for securing said plate in selectable attitudes at a side wall of the bow window, an arrow rest and arrow-shaft-engaging side bar structure including a generally horizontal arm and a vertical leg fastened thereto and extending generally upward therefrom, means for adjustably positioning said vertical leg along said horizontal arm, a shaft connected to and projecting upwardly of said horizontal arm at an end thereof proximate a rearward edge of the said wall of the bow window, said mounting plate being formed with a bushing-like tubular wall defining a sleeve extending vertically and in a plane generally paralleling a plane defined by the side wall of the bow window, said shaft of said arrow rest being pivotally journaled in said tubular sleeve for pivotally arcuate movement therewithin, cam means and means for locking said cam means on said shaft for displacement therewith, said cam means being responsive to pressure applied by an arrow against said leg of said arrow rest and through said horizontal arm to said shaft to overcome bias forces acting on said cam and to move arcuately with said shaft.

2. The structure as set forth in claim 1, wherein said mounting plate comprises two sections including a rearward section offset laterally toward the side wall of the window of the bow, and wherein said bushing-like, tubular wall is formed in said rearward section.

3. The structure as set forth in claim 2 wherein said shaft of said arrow rest is displaced in a direction of the side wall of the window wall of the bow and somewhat laterally beyond a physical limit defined by a face of the window side wall, whereby an edge of the side wall constitutes a limit stop for said arm of said arrow rest as the rest is forcibly pivotally displaced upon release of an arrow.

4. The structure as set forth in claim 1 wherein said arm of said arrow rest is bent reversely upon itself at a forwardly presented end portion thereof to establish a pair of horizontally-disposed, spaced, parallel upper and lower arms.

5. The structure as set forth in claim 4 wherein said vertical leg of said arrow rest is formed with a bore extending diametrically therethrough and wherein said upper arm of said arrow rest is slidably received therewithin, said leg of said arrow rest being formed at a lower end thereof with a groove, and said leg being keyed onto said lower arm of said arrow rest along said groove to stabilize said leg against rotation in a vertical plane, while permitting selective sliding displacement positioning of said leg along said arm of said arrow rest.

6. The structure as set forth in claim 5 and further comprising a threaded axial bore formed in said leg and opening upwardly, a screw threadedly received in said bore and threadedly advancable downwardly therethrough stressingly to engage and bear against said upper arm of said arrow rest to lock said leg in selectable, fixed positions along said upper arm.

7. The structure as set forth in claim 1 and further comprising spring means in functional engagement with said cam means, and wherein said cam means includes a generally flattened section, and wherein said spring means bears against said flattened section of said cam when said arrow reset is in a standby mode, and said spring means is under minimum distortion.

8. The structure as set forth in claim 1 wherein said cam means includes means for rotatably positioning said cam means on said shaft for facilitating functional adjustment of said cam means.

9. An arrow rest assembly for attachment to a vertical side wall of an archery bow above a horizontal shelf of a cut-away window zone in a handle portion of the bow, said arrow rest assembly comprising mounting plate means and means for securing said mounting plate means to said side wall of the window zone to overlie said side wall of the archery bow, generally horizontal arm means and means for securing said arm means to project laterally into the window zone of the bow for supporting an arrow shaft thereon during travel therealong upon release of an arrow in flight, arrow shaft side support leg means for engaging and guiding the arrow during flight from the bow, and means for fastening said side support leg means to said arm means, to project upwardly therefrom and generally normally thereto, rod means attached to and projecting generally normally of said arm means and upwardly thereof at an end of said arm means to define an axis of rotational movement of said arrow-shaft-supporting means, bushing-like sleeve means supported on said mounting plate means for receiving said rod means therewithin as a bearing housing for said rod means, means securing said sleeve means to said mounting plate means of said arrow rest assembly, cam means and means fastening said cam means on said rod means for movement in response to movement of said rod means, spring means, and means mounting said spring means on said plate means to engage and bear resiliently against said cam means as a follower for said cam means, said spring means being in stressing engagement against said cam means to bias said arrow-shaft-supporting arm means to a rearward, retracted position, and said arm means being responsive to frictional forces applied thereto by an arrow when shot from the bow to overcome bias forces of said spring means against said cam means and to pivot toward said side wall of said window zone of said bow.

10. The assembly as set forth in claim 9 and further comprising fastener means for securing said mounting plate means in selectable rotational orientation and for supporting said mounting plate means adjacent to and laterally of said side wall in selectable spacing with respect thereto.

11. The assembly as set forth in claim 9 wherein said arm means is looped upon itself to define a pair of vertically spaced, overlying, generally parallel upper and lower lineal sections, and wherein said leg means is mounted on said upper of said lineal sections and guides along said lower of said lineal sections of said arm means.

12. The assembly as set forth in claim 9 wherein said leg means is slidably positionable along said lineal sections of said arm means, and further comprising locking means for securing said leg means in selectable positions along said arm means.

13. The assembly as set forth in claim 9 and further comprising a generally flat face on said cam means, and wherein said spring means is a leaf-like spring secured in stressing engagement against said generally flat face of said cam means.

14. The assembly as set forth in claim 9 and further comprising means for rotating said mounting plate in a vertical plane to effect, selectively, angular adjustment correlated with upward and downward displacement of said plate-means-carried arm means.

15. The assembly as set forth in claim 9 and further comprising frame means formed in said mounting plate means for bridging said cam means and limiting vertical displacement thereof, and wherein said rod means is positionable upwardly and downwardly in said sleeve means and with respect to said cam means and said mounting plate means to position said arm means in vertically selectable positions.

16. The assembly as set forth in claim 9 wherein said mounting plate means comprises spaced interconnected forward plate means and rearward plate means, wherein said rearward plate means generally parallel but is offset from said forward plate means in a direction toward said side wall of the archery bow, and wherein said sleeve means which supports said arm means is carried by said rearward plate means, whereby pivotal movement of said arm means upon traverse of an arrow shaft is limited by abutting engagement of said arm means against a rearward vertical edge of the side wall of the bow.

17. The assembly as set forth in claim 9 wherein said cam means includes facet means for establishing two stable modes including a ready mode in which an arrow shaft rest on said arm means, and a mode in which said arm means is displaced toward a sidewall of the window zone of an archery bow.

* * * * *